US005537735A

United States Patent [19]

Lawruk et al.

[11] Patent Number: 5,537,735

[45] Date of Patent: Jul. 23, 1996

[54] SEPARATING, TERMINATING, ASSEMBLING TOOL FOR ELECTRICAL CONNECTOR

[75] Inventors: Stephen P. Lawruk, Middletown; Kerry J. Stakem, Hummelstown, both of Pa.

[73] Assignee: The Whitaker Corporation, Wilmington, Del.

[21] Appl. No.: 367,562

[22] Filed: Jan. 3, 1995

[51] Int. Cl.[6] ..... H01R 43/01; H01R 43/04

[52] U.S. Cl. ..... 29/749; 29/33 M; 29/861

[58] Field of Search ..... 29/38 M, 564.4, 29/748, 749, 759, 861, 866; 414/739, 741

[56] References Cited

U.S. PATENT DOCUMENTS

| | | | |
|---|---|---|---|
| 4,126,935 | 11/1978 | Rhines et al. | 29/749 X |
| 4,281,442 | 8/1981 | Senior et al. | 29/749 X |
| 4,476,905 | 10/1984 | Maben | 29/749 X |
| 4,566,164 | 1/1986 | Brown et al. | 29/33 M |
| 4,580,340 | 4/1986 | Shields | 29/861 |
| 4,623,293 | 11/1986 | Brown et al. | 414/126 |
| 4,680,841 | 7/1987 | Schneider et al. | 29/33 M |
| 4,682,391 | 7/1987 | Hall, Jr. et al. | 29/33 M |
| 4,839,962 | 6/1989 | Long, Jr. | 29/749 |
| 4,870,752 | 10/1989 | Brown et al. | 29/866 |
| 4,903,403 | 2/1990 | Brown et al. | 29/861 |
| 5,074,038 | 12/1991 | Fath | 29/861 |

FOREIGN PATENT DOCUMENTS

| | | | |
|---|---|---|---|
| 89779 | 9/1983 | European Pat. Off. | 29/749 |
| 2937689 | 6/1980 | Germany | 29/749 |

*Primary Examiner*—Peter Vo

[57] ABSTRACT

A tool to attach a preassembled connector transversely on a ribbon cable. The tool has an upper portion and a lower portion which may be moved apart and together. The connector is disposed between the upper and lower portions and grasped by fingers extending from the respective upper and lower portions. The portions are moved apart to separate the members of the connector and to receive the ribbon cable between the members. The upper and lower portions are moved toward one another to join the members of the connector and to terminate the connector on the ribbon cable. A method of attaching the connector to the ribbon cable is disclosed.

5 Claims, 10 Drawing Sheets

Fig. 6
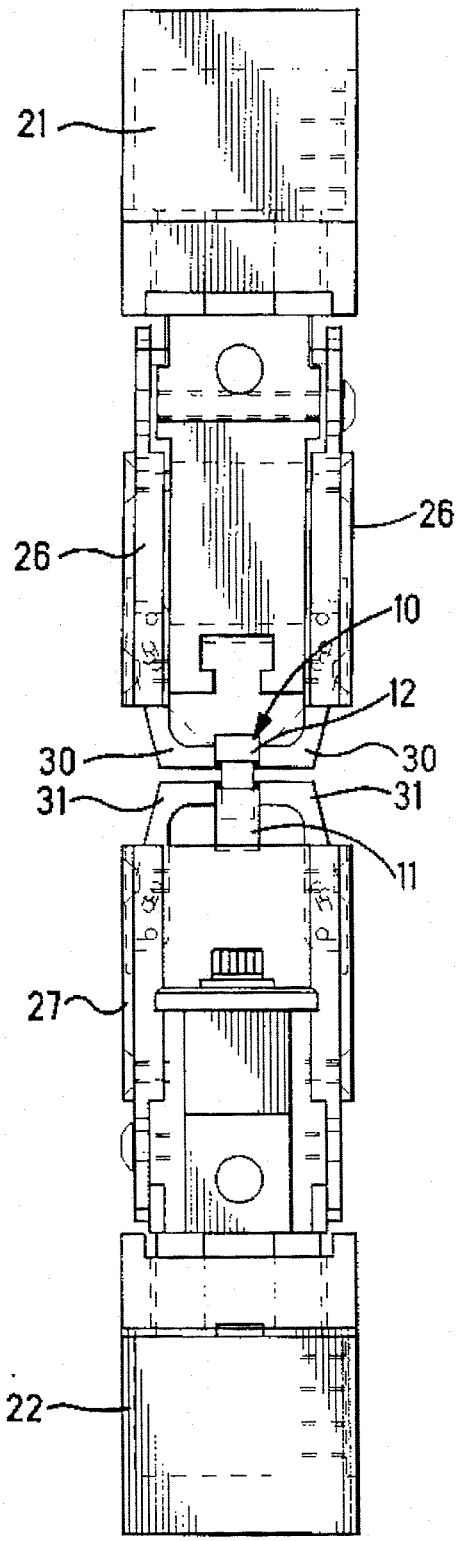
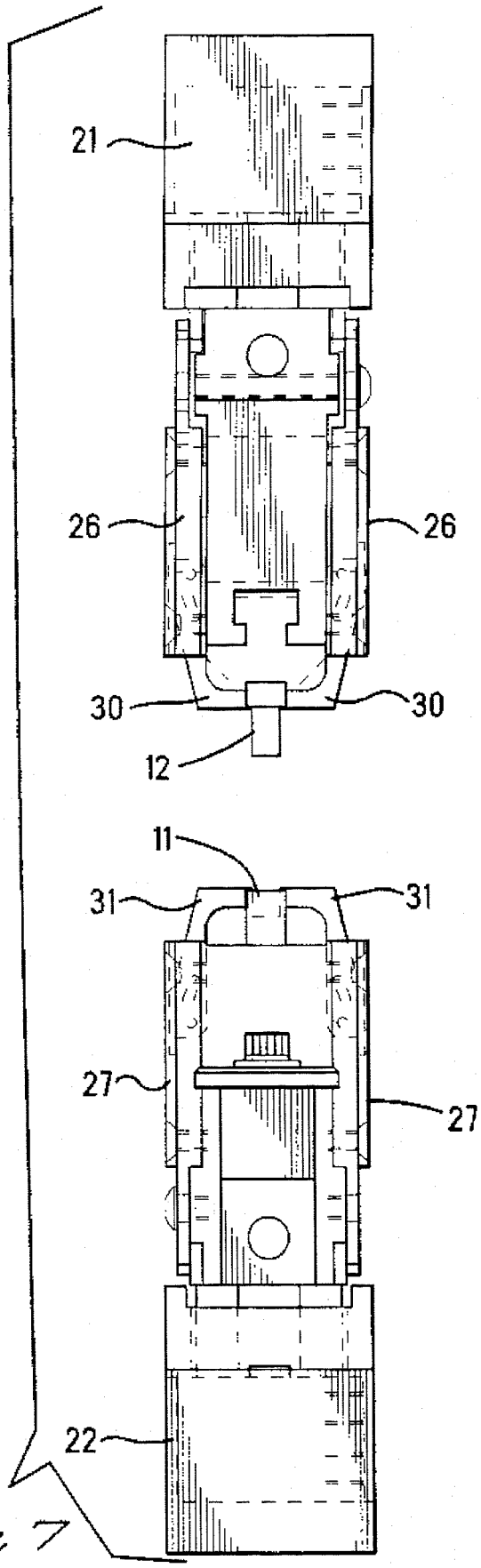
Fig. 7

Fig. 10
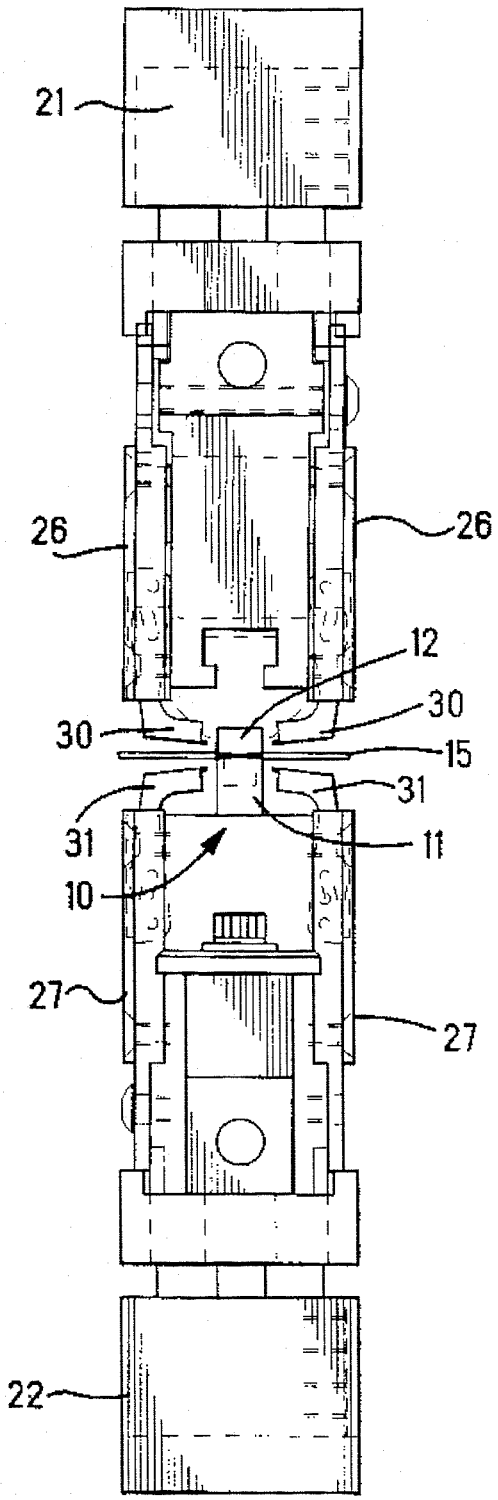
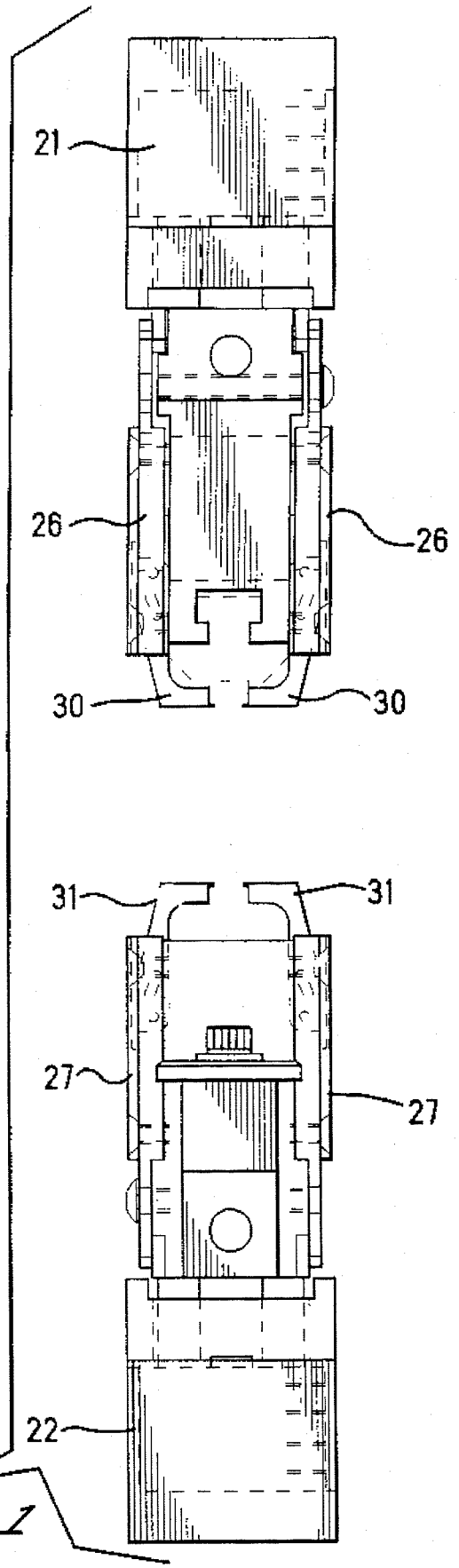
Fig. 11

SEPARATING, TERMINATING, ASSEMBLING TOOL FOR ELECTRICAL CONNECTOR

FIELD OF THE INVENTION

The present invention relates to a tool for attaching a connector on a ribbon cable and, more particularly, to a tool and a method which separates a preassembled connector and attaches the connector to the ribbon cable.

BACKGROUND ART

The attachment of connectors to ribbon cable are well known and the applicants are familiar with the following:

| U.S. Pat. No. | Inventor(s) |
|---|---|
| 4,566,164 | Brown et al |
| 4,623,293 | Brown et al |
| 4,682,391 | Hall, Jr. et al |
| 4,839,962 | Long, Jr. |
| 4,870,752 | Brown et al |
| 4,903,403 | Brown et al |
| 5,074 038 | Fath |

In most of these devices, the connector comprises either a separate connector housing and a separate cover which are disposed on opposite surfaces of the ribbon cable or a preassembled connector housing and cover with an opening through which the ribbon cable is inserted. The connector having separate members produces problems of alignment and registry of the connector housing and cover. The preassembled connector is limited in that the ribbon cable must be fed through the connector requiring specialized equipment and limiting the assembly. One method of assembly is having a length of ribbon cable, initially attaching a connector at one end of the ribbon cable and subsequently feeding the connectors from the opposite end of the ribbon cable. Another method is to feed all of the connectors on a lower portion of the frame away from one another thereby separating the connector housing member of the connector from the cover member of the connector. The ribbon cable is received between the separated connector housing member and cover member. Means are provided for moving the upper portion and the lower portion of the frame toward one another to join the cover member and the connector housing member and to terminate the connector onto the ribbon cable.

A method of separating a preassembled connector and attaching the separated connector to a ribbon cable is also disclosed.

These and other objects of the present invention will become apparent from a reading of the following specification, taken in conjunction with the enclosed drawings.

BRIEF DESCRIPTION OF THE DRAWINGS

FIGS. 4–7 are a sequence of front views of the tool of the present invention showing the grasping and separation of the connector.

FIGS. 8–11 are a sequence of front views of the present invention showing receipt of the ribbon cable, termination of the connector and opening of the tool to reinitiate the sequences.

DESCRIPTION OF THE PREFERRED EMBODIMENTS

Figures 1, 2:
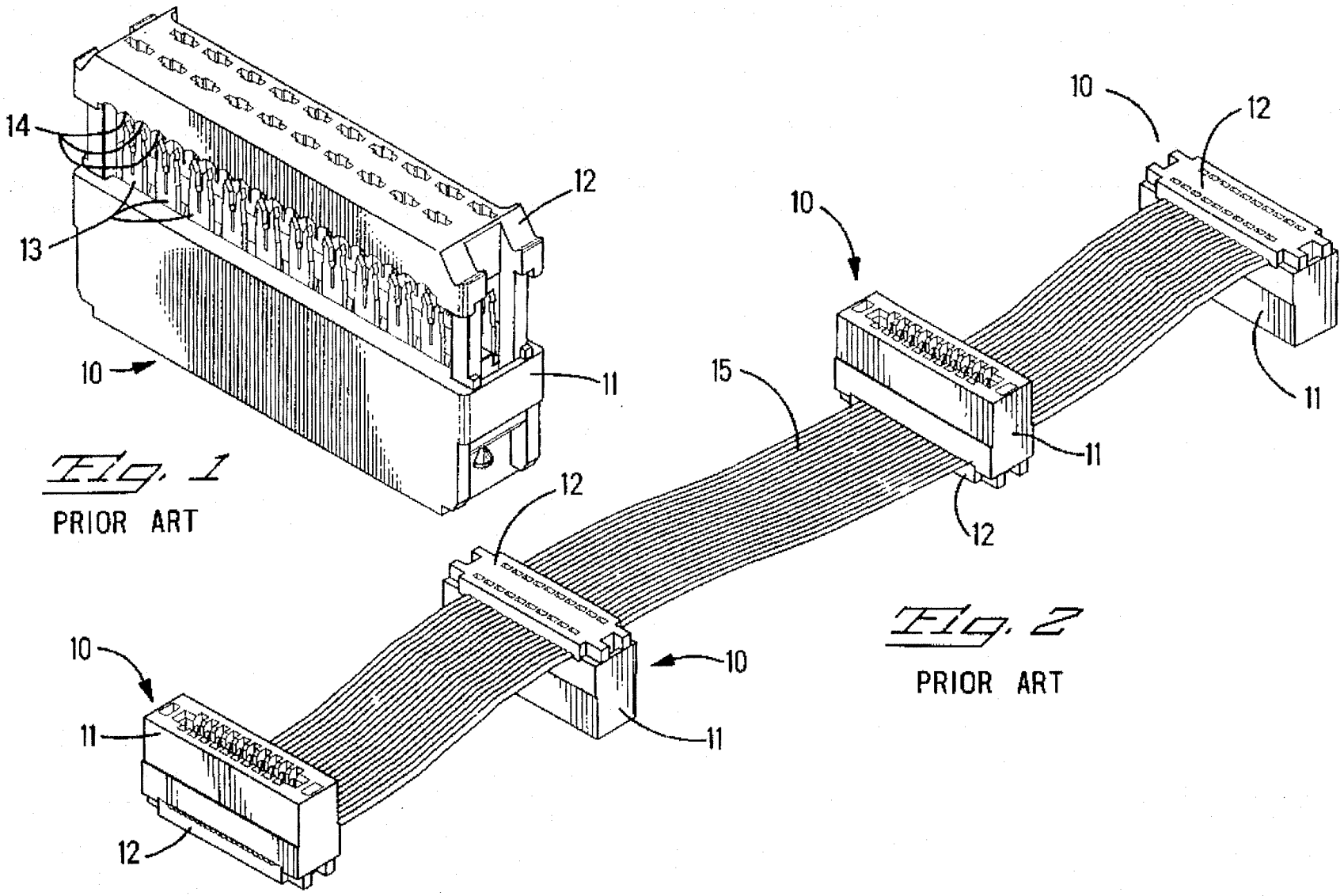
FIG. 1 PRIOR ART
FIG. 2 PRIOR ART
FIG. 1 is a perspective view of a typical connector (prior art).
FIG. 2 is a perspective view of connectors attached to a ribbon cable (prior art).
Figure 3:
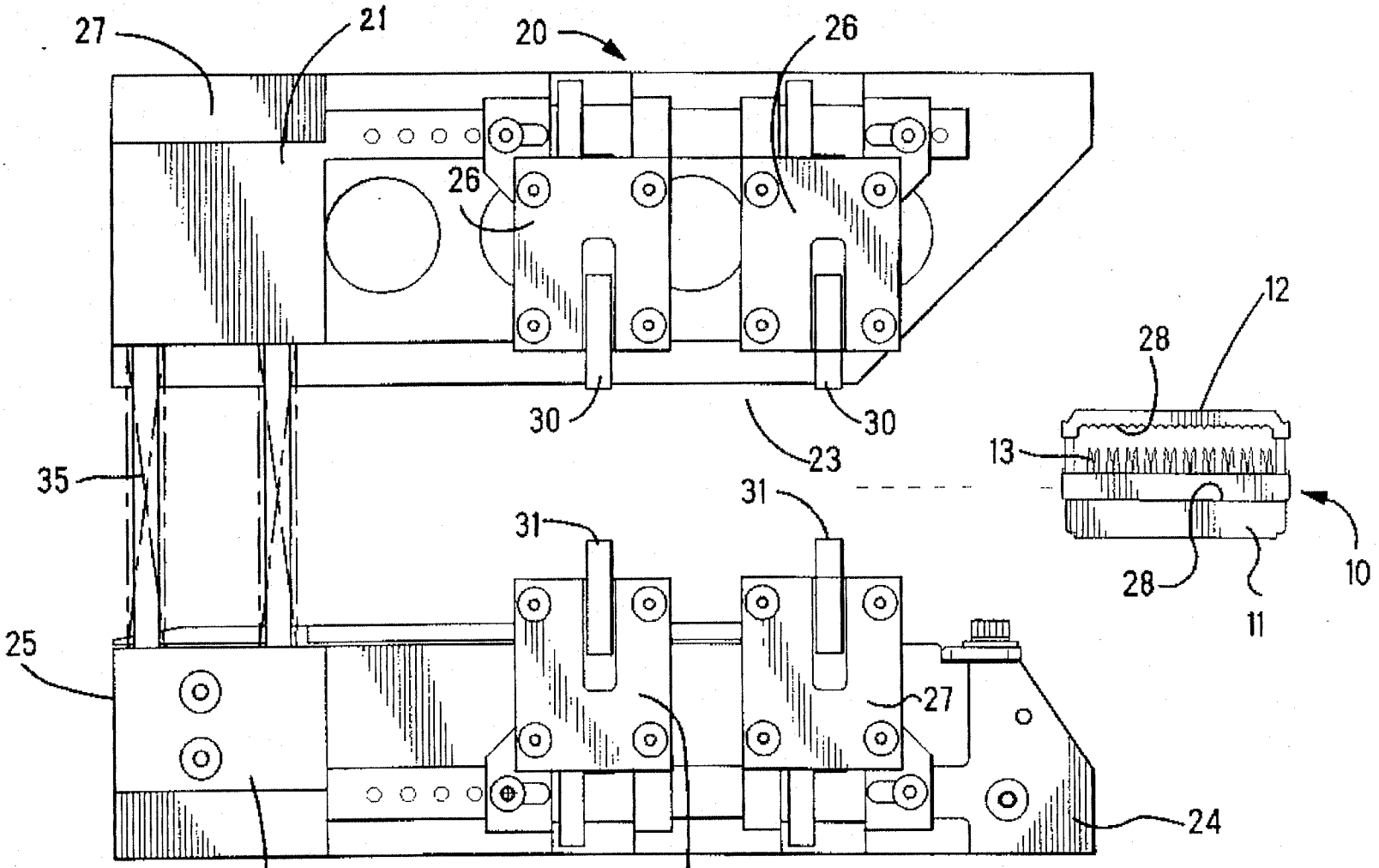
FIG. 3 is a side elevation view of the tool of the present invention.

Referring to the prior art (FIGS. 1–2), a typical connector 10 has a connector housing member 11 and a cover member 12. A plurality of terminals 13 are disposed in the connector housing member 11. Between the terminals 13 on the connector housing member 11 and the cover member 12, there is a space 14. When the connector 10 is produced, generally the connector housing member 11 is attached to the cover member 12 for several reasons including improved protection for the terminals, prevention of loss of one of the members and ease of production. A plurality of connectors 10 are attached to a ribbon cable 15 with discrete spaces between the connectors 10. Preferably, from one (1) to ten (10) connectors 10 may be attached transversely to a length of ribbon cable 15. If desired, the connectors 10 may be attached with the connector housing members 11 all on the same side of the ribbon cable 15 or with selected connector housing members 11 on opposite sides of the ribbon cable 15. The disposition is dependent upon subsequent use. Also, the ribbon cable 15 may be of varying widths. The prior art discloses threading the ribbon cable 15 sequentially through the space 14 in each respective connector 10. In order to efficiently assemble the connectors 10 on the ribbon cable 15, the connectors 10 must be prealigned in the desired order since any rearrangement would require the removal of all intervening connectors 10 from the ribbon cable 15 in order to slide off the connector 10 to be changed.

The present invention is a tool 20 to open the preassembled connector 10, to place the connector transversely on the ribbon cable 15 and to terminate the connector 10 on the ribbon cable 15 at a desired distance from adjoining spaced apart connectors 10.

The tool 20 has a frame having an upper portion 21 and a lower portion 22, with an opening 23 therebetween. The upper portion 21 and the lower portion 22 are movable with respect to one another in that the respective portions 21, 22 can be adjusted to be spaced farther apart and brought closer to one another in a vertical direction and the opening 23 therebetween may, accordingly, become greater and smaller. The portions 21, 22 may be moved pneumatically, hydraulically or mechanically. On the upper portion 21 there is a first means 26 to removably grasp the connector 10. As will be described, depending upon the desired attachment to the ribbon cable 15, the first means 26 may removably grasp the connector housing member 11 or the cover member 12 of the connector 10. On the lower portion 22 of the tool 20, there is a second means 27 to removably grasp the connector. The second means 27 may removably grasp the cover member 12 or the connector housing member 11 of the connector, the member being grasped being the opposite from that grasped by the first means 29 (FIGS. 3–14).

In a preferred embodiment, the cover member 12 and the connector housing member 11 of the connector 10 are each formed with a shoulder 28 extending longitudinally from the front to the back of each member 11, 12 on both sides of each member 11, 12. The first means 26 has a pair of opposed movable fingers 30 which extend downwardly from the upper portion 21 into the opening 23. Similarly, the second means 27 has a pair of opposed movable fingers 31 which extend upwardly from the lower portion 22 into the opening 23. The movable fingers 30 on the first means 26 may be opened with respect to one another to receive the selected member 11, 12 of the connector 10 between the fingers 30. The fingers 30 close to be in contact with the respective shoulders 28 and to hold the respective member 11, 12. Similarly and simultaneously, the movable fingers 31 on the second means 27 may be opened with respect to one another to receive the selected member 11, 12 of the connector 10 between the fingers 31. The fingers 31 close to be in contact with the respective shoulders 28 and to hold the respective member 11, 12. The movement of the fingers 30, 31 may be activated mechanically, pneumatically or hydraulically. The first means 26 and the second means 27 may also be disposed laterally as desired between the front 24 and the back 25 of the tool 20. It is preferred that with longer connectors 10, two sets of first means 26 be disposed adjacent to one another on the upper portion 21 and two sets of second means 27 be disposed adjacent to one another on the lower portion 22. The sets of first means 26 should be diametrically opposed to the sets of second means 27 so that the longer connector 10 may be grasped securely. Longer connectors 10 are used when a broad ribbon cable 15 is required.

Figures 4, 5:
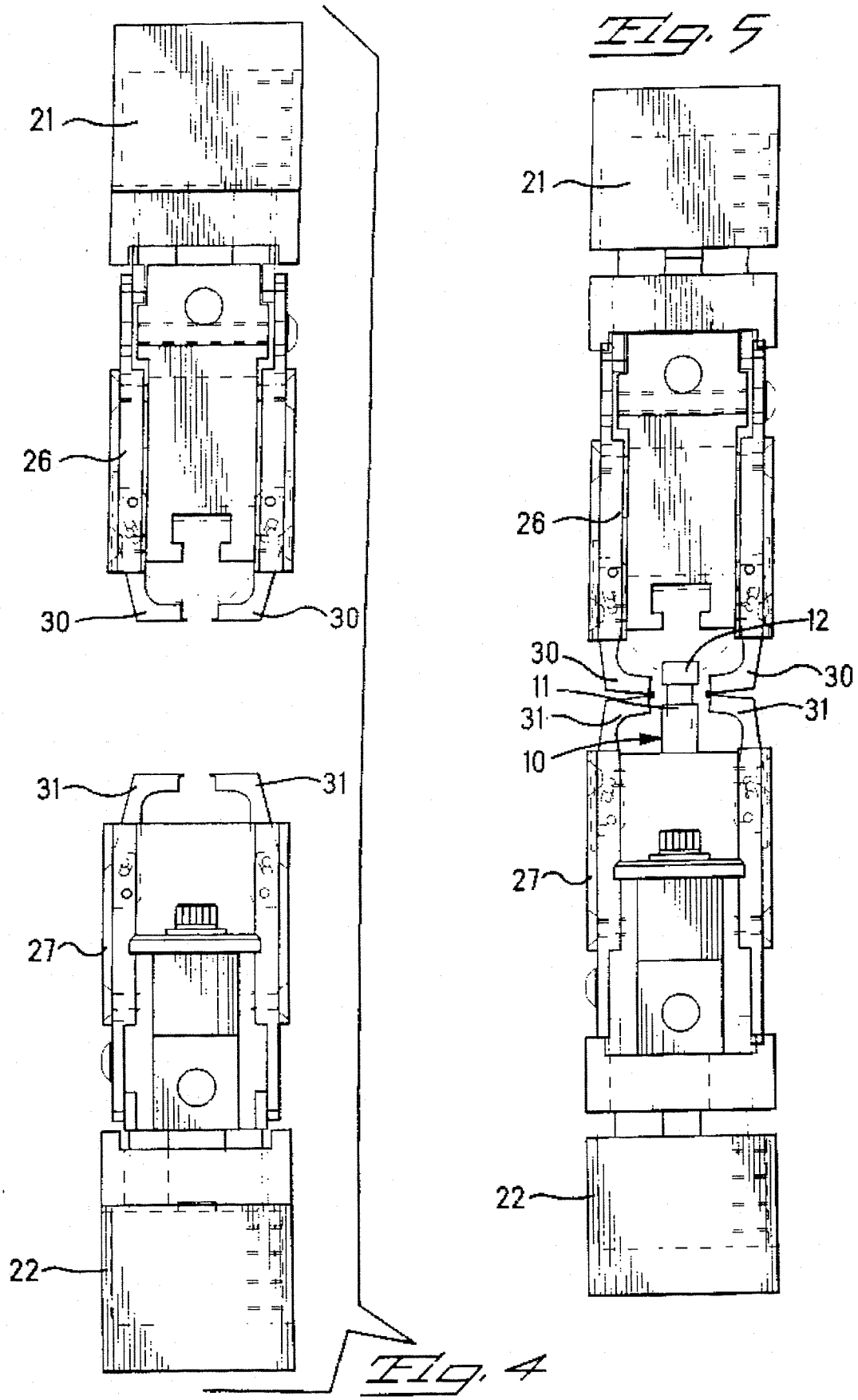
Figure 8:
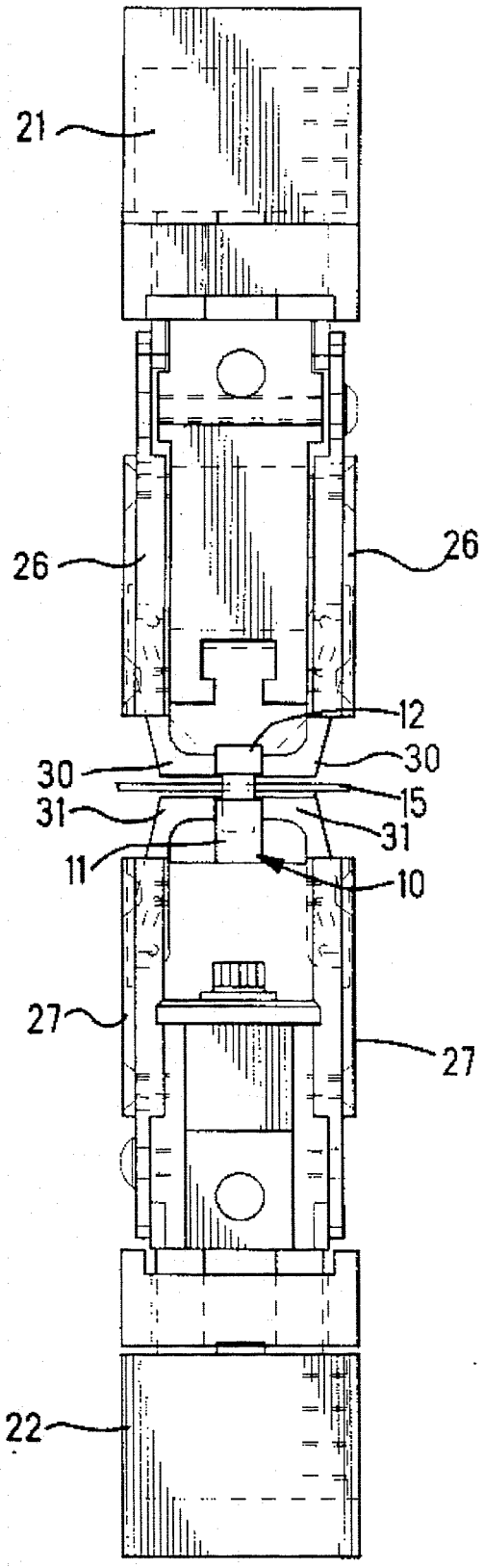
Figure 9:
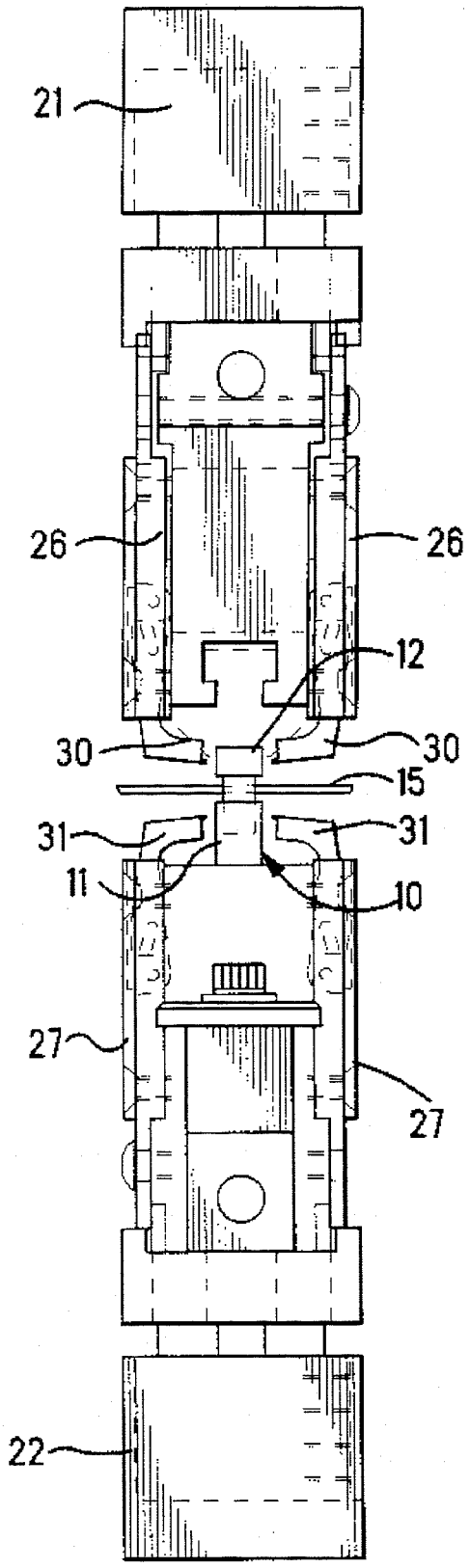

As shown in FIG. 4, the upper portion 21 and lower portion 22 of the tool 20 are moved away from each other and the fingers 30, 31 on the respective first means 26 and second means 27 are closed. The connector 10 is received between the opened fingers 30, 31 after the upper portion 21 and lower portion 22 are moved towards one another to a predetermined position as in FIG. 5. In FIG. 6, the fingers 30, 31 grasp the respective cover member 12 and connector housing member 11 of the connector 10. FIG. 7 shows the upper portion 21 and the lower portion 22 moved away from one another while the fingers 30, 31 continue to grasp; respectively, the cover member 12 and the connector housing member 11, thereby separating the cover member 12 from the connector housing member 11. Although the Figures show the fingers 30 on the first means grasping the cover member 12 and the fingers 31 on the second means grasping the connector housing member 11, the connector 10 may be inverted if desired and the fingers 30 may grasp the connector housing member 11 while the fingers 31 may grasp the cover member. This inversion permits the desired orientation of the connector 10 on the ribbon cable 15. The desired orientation may also be obtained by inversion of the tool 20 after the connector 10 has been grasped by the fingers 30, 31. Preferably, the tool 20 is moved toward the ribbon cable 15 but, alternately, the ribbon cable 15 may be moved toward the tool 20. In either embodiment, the ribbon cable 15 is received between the opened members 11, 12 without having to thread or feed the ribbon cable 15 into a narrow opening between the joined members 11, 12. As shown in FIG. 8 the upper portion 21 and the lower portion 22 are moved towards one another with the fingers 30, 31 holding the members 12, 11 respectively. The fingers 30, 31 are opened, releasing the grasp on the members 12, 11 as in FIG. 9. The upper portion 21 and the lower portion 22 are moved toward one another to terminate the connector 10 on the ribbon cable 15 as shown in FIG. 10. It is preferred that the cover member 12 be placed against the ribbon cable 15 before the connector housing member 11. In this manner, the ribbon cable 15 is supported by the cover member 12 and the terminals 13 in the connector housing member 11 may more readily pierce the ribbon cable 15. The tool 20 is retracted from the ribbon cable 15 with the attached connector 10 and the tool 20 is available to resume the sequence (FIG. 11).

Figure 12:
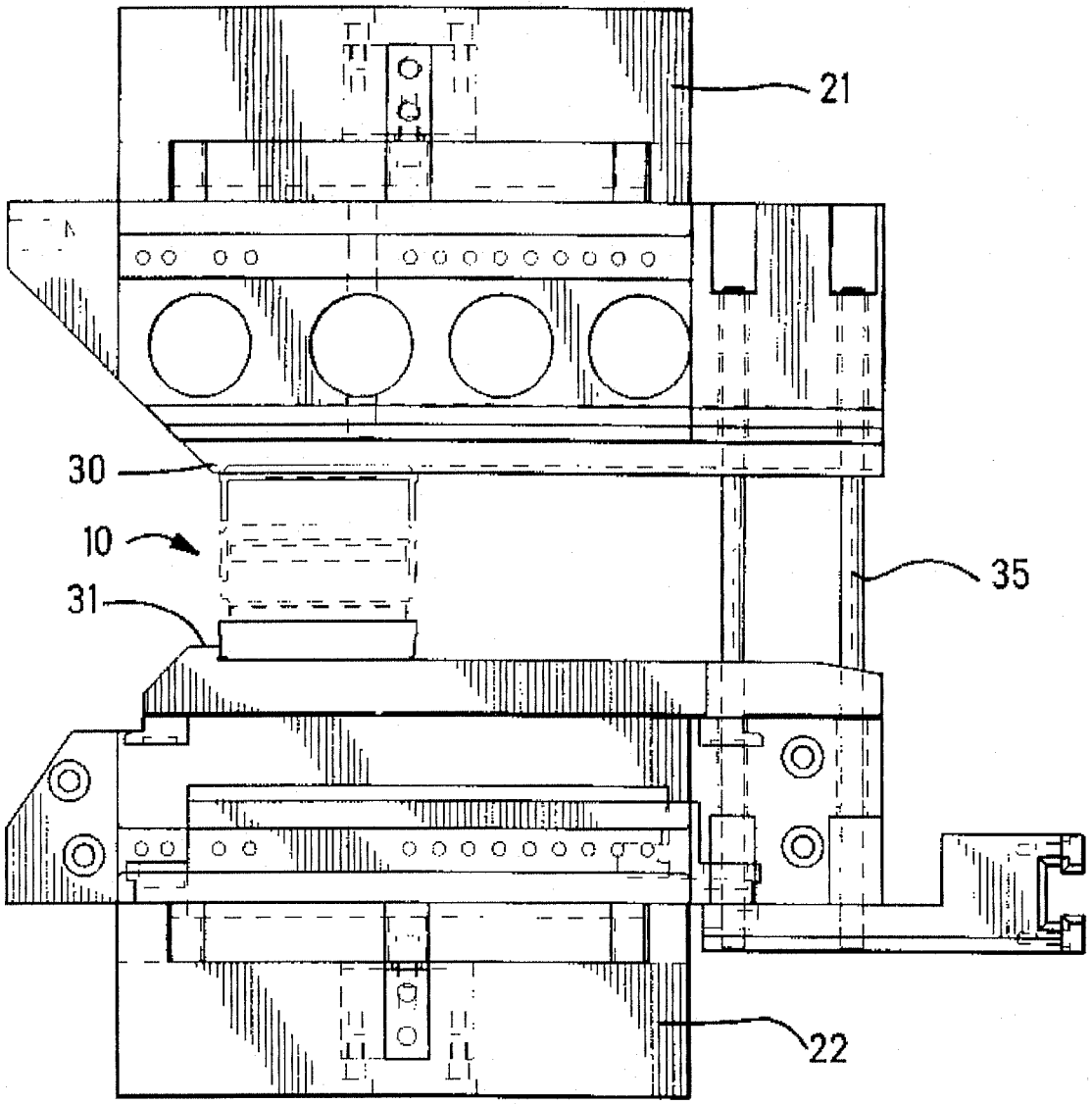
FIG. 12 is a side elevation view of the tool of the present invention with the upper portion and the lower portion separated.
Figure 13:
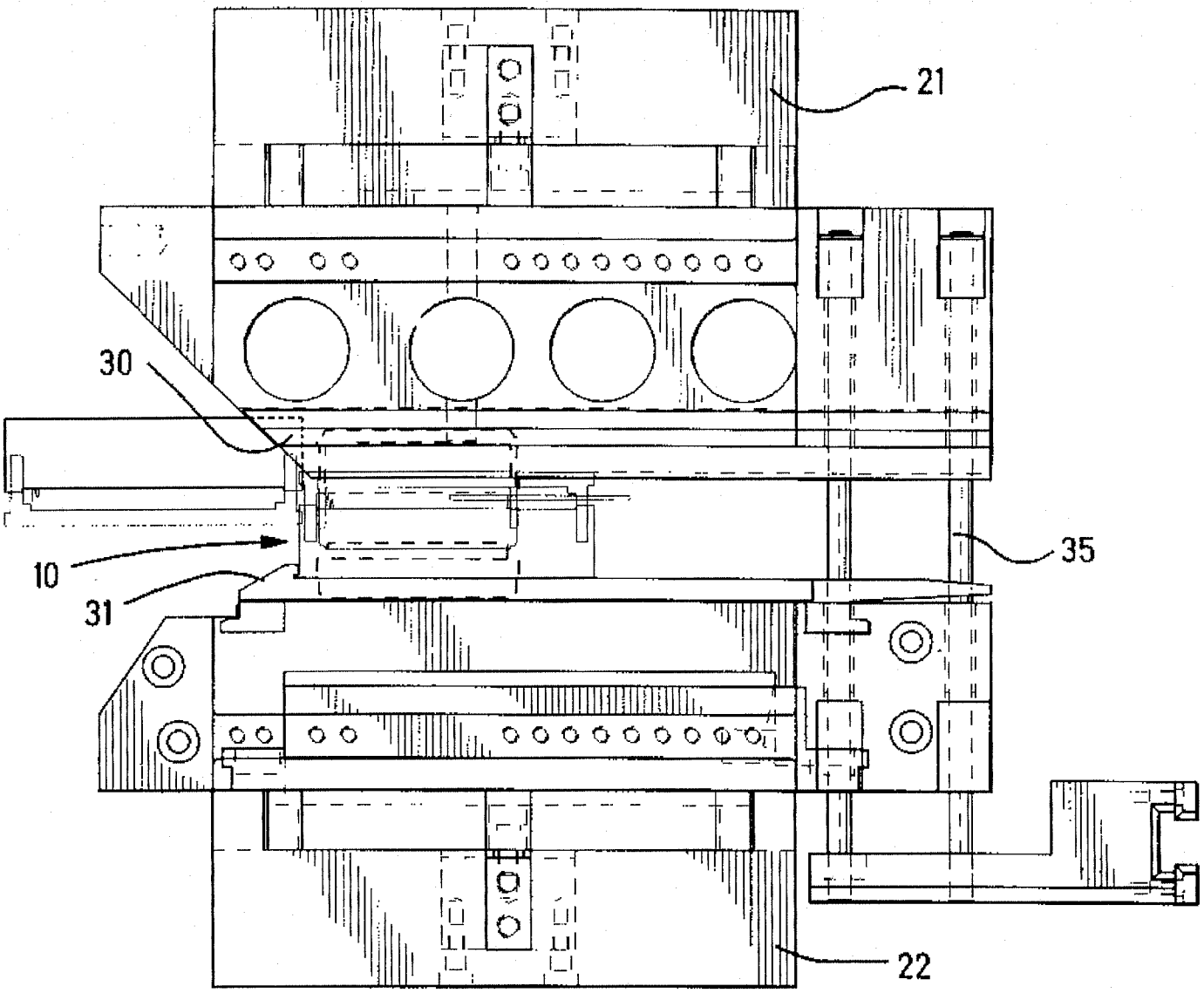
FIG. 13 is a side elevation view of the tool of the present invention holding the connector between the upper portion and the lower portion.
Figure 14:
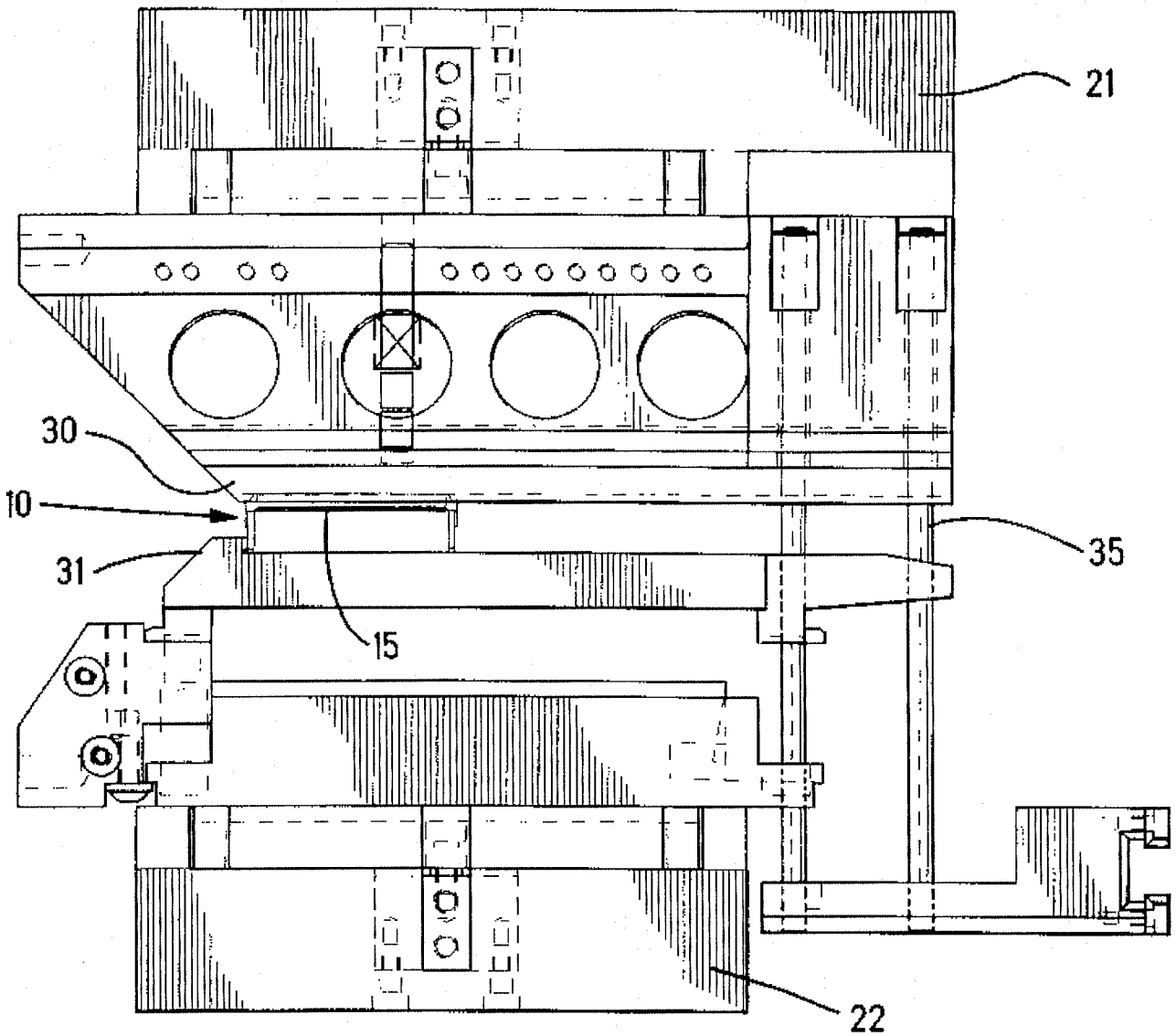
FIG. 14 is a side elevation view of the tool of the present invention with the upper portion and the lower portion terminating the connector on the ribbon cable.

The relative positions of the upper portion 21 and the lower portion 22 of the tool 20 are further shown in FIGS. 12–14. A resilient means 35, such as a spring, is preferably disposed between the upper portion 21 and the lower portion 22 to separate the respective portions in the normal, non-operative mode.

Figure 15:
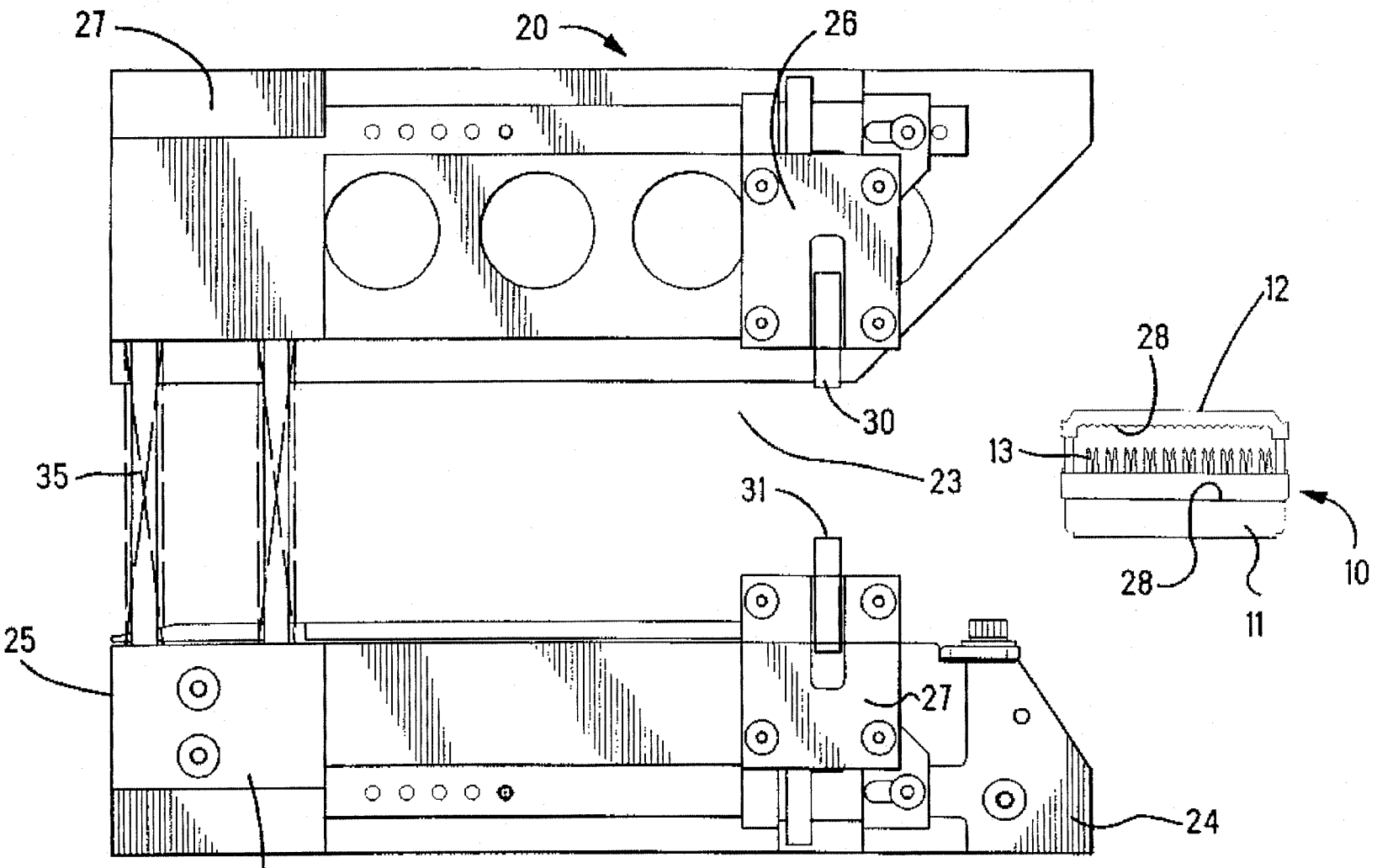
FIG. 15 is a side elevation view of the tool, similar to FIG. 3, showing a single pair of connector grasping means.

Although the figures show fingers 30, 31 on the first means 26 and the second means 27, alternate embodiments may have jaws 32 to grasp the connector housing member 11 and the cover member 12 (FIG. 15).

The tool 20 also has sensors and detectors to electrically test the terminated connector 10/ribbon cable interface for shorting, open circuits and continuity.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A tool to attach a connector transversely on a ribbon cable, the connector having first and Second connector members, each connector member having a pair of opposite sides, each side having a shoulder thereon, the members being removably attached to one another, the connector having a plurality of terminals disposed in said first connector member spaced apart from said second connector member, the tool comprising a frame having an upper portion and a lower portion, an opening being formed between the upper portion and the lower portion, the connector being disposed in the opening; the upper portion having a first means to removably grasp the first connector member, the lower portion having a second means to removably grasp the second connector member, where said means to removably grasp said connector members have movable fingers thereon, the fingers being removably connected to the respective shoulders on the respective members of the connector, means for moving the upper portion of the frame and the lower portion of the frame away from one another, thereby separating the respective connector members, the ribbon cable being received between the separated connector members, and means for moving the upper portion of the frame and the lower portion of the frame toward one another to join the first and second connector members thereby terminating the connector onto the ribbon cable.

2. The tool of claim 1, further comprising the frame having a front end and an opposite back end, the movable fingers on each the upper portion of the frame and the lower portion of the frame being adjustable laterally between the front end and the back end of the frame.

3. The tool of claim 1, further comprising pneumatic means for moving the upper portion and the lower portion of the frame with respect to one another.

4. The tool of claim 1, further comprising the upper portion of the frame being resiliently connected to the lower portion of the frame.

5. The tool of claim 1, wherein the first and second means to removably grasp the members of the connector are a first pair of opposed movable jaws on the upper portion of the frame and a second pair of opposed movable jaws on the lower portion of the frame, the respective pairs of jaws grasping the respective members of the connector.

* * * * *